US007950972B1

(12) United States Patent
Chen et al.

(10) Patent No.: US 7,950,972 B1
(45) Date of Patent: May 31, 2011

(54) ELECTRICAL FEMALE TERMINAL

(75) Inventors: Ping Chen, Novi, MI (US); Robert Hasegawa, Novi, MI (US)

(73) Assignee: J. S. T. Corporation, Farmington Hills, MI (US)

( * ) Notice: Subject to any disclaimer, the term of this patent is extended or adjusted under 35 U.S.C. 154(b) by 0 days.

(21) Appl. No.: 12/629,347

(22) Filed: Dec. 2, 2009

(51) Int. Cl.
*H01R 13/11* (2006.01)

(52) U.S. Cl. ..... 439/852

(58) Field of Classification Search ..... 439/852, 439/853–857, 842, 867
See application file for complete search history.

(56) References Cited

U.S. PATENT DOCUMENTS

| | | | | |
|---|---|---|---|---|
| 3,713,080 | A | 1/1973 | Kennedy | |
| 5,540,603 | A | 7/1996 | Fujiwara | |
| 7,351,122 | B2 * | 4/2008 | Suemitsu et al. | 439/852 |
| 7,419,411 | B2 * | 9/2008 | Kaneko | 439/852 |
| 7,530,859 | B2 * | 5/2009 | Moll et al. | 439/852 |
| 7,785,159 | B2 * | 8/2010 | Kumakura | 439/852 |
| 2002/0077001 | A1 * | 6/2002 | Chen | 439/852 |
| 2008/0070452 | A1 * | 3/2008 | Komiyama et al. | 439/852 |

* cited by examiner

*Primary Examiner* — Jean F Duverne
(74) *Attorney, Agent, or Firm* — Rader, Fishman & Grauer PLLC

(57) ABSTRACT

An electrical female terminal includes a female terminal body and a spring assembly. The female terminal body extends along and about a longitudinal axis and has a top wall, an opposite bottom wall and a pair of opposing side walls that connected to each other to form a generally box-shaped passageway extending through the female terminal body. The spring assembly has a beam portion, an interconnect portion and a contact portion. The beam portion is connected to one of the side walls. The interconnect portion is connected generally perpendicularly to the beam portion and interconnects the beam portion and the contact portion. The contact portion is connected to the interconnect portion and projects forwardly from the interconnect portion in a cantilevered manner. When a male terminal pin is inserted into the electrical female terminal, the spring assembly twists towards the one side wall to which the beam portion is connected.

20 Claims, 9 Drawing Sheets

ELECTRICAL FEMALE TERMINAL

FIELD OF THE INVENTION

The present invention is related to an electrical female terminal. More specifically, the present invention is directed to an electrical female terminal that includes a spring assembly that twists when an electrical male terminal is inserted into the electrical female terminal.

BACKGROUND OF THE INVENTION

Many types of electrical female terminals are known in the art. One such electrical female terminal is described in U.S. Pat. No. 3,713,080. This female terminal receives a blade terminal. The main elements forming the female terminal are first, second, third and fourth walls which are joined together into an integral unit at their edges between the first and the second, the second and the third, and the third and the fourth walls. A co-operable lock device is formed, in part, on a free end of the first wall and, in part, on a free end of the fourth wall. The co-operable lock device locks the walls into a closed configuration to define therein an interior volume in which the first and the third walls are in facing relationship and the second and the fourth walls are in a facing relationship. Individual ones of a pair of terminal elements are formed integrally from respective ones of a pair of facing walls. Each of the terminal elements is folded back from its point of attachment to the wall into the interior volume of the terminal to form at main blade terminal contacting portion which is resiliently deflectable when engaged by, an inserted blade terminal.

A drawback of this female terminal is that it cannot be sized for a 0.5 terminal system. Also, if the main blade terminal contacting portion is scaled-down, it will not provide a proper resilient normal force for tin terminals.

Another such female terminal is disclosed in U.S. Pat. No. 5,540,603 which describes a female contact. The female contact has a male contact receiving section for receiving a male contact, a wire terminating section for connecting a wire to the female contact and a spring-loaded contacting section that extends from a bottom wall of the female contact. A protrusion extends inwardly from spaced longitudinal locations along a side wall of the male contact receiving section so that the spring-loaded contacting section engages the protrusion when the spring-loaded contacting section has a force pushing it downward towards the bottom wall, thereby providing a surface that is attached to more than one location on the side wall which can better withstand a downward force and prevent deformation of the spring-loaded contacting section.

Like the above prior art female terminal, this female contact, if scaled-down, will not provide a proper resilient normal force for tin terminals. Additionally, scaling-down of this female contact will compromise its structural integrity.

Yet another female terminal is taught in U.S. Pat. No. 7,351,122 as a receptacle terminal. The receptacle terminal includes a contact section. The contact section includes a substantially L-shaped contact spring, a first protection member and a second protection member. The contact spring includes a link arm and a contact arm. The link arm has a first edge and a second edge opposite the first edge. The first edge extends in a mating direction of a mating terminal. The contact arm extends along the first edge and has a tip end portion connected to the first edge. The first protection member has a first link arm protection member opposing the second edge. The second protection member has a second link arm protection member opposing the first edge. The receptacle terminal ensures protection of the contact spring and necessary contact pressure between the receptacle terminal and a mating terminal while having a small external size.

The L-shaped contact spring provides additional spring reinforcement. Unfortunately, to create the "L-shape" of this receptacle terminal, multiple corner cuts are required during its fabrication. As a result, its structural integrity is weakened. Furthermore, its structure is complex and difficult to manufacture.

It would be advantageous to provide an electrical female terminal that can be scaled-down in size while providing a proper resilient normal force, even for tin terminals. It would be beneficial to provide an electrical female terminal that can be scaled-down in size without compromising its structural integrity. It would also be beneficial to provide an electrical female terminal that can be scaled-down in sized while having an L-shaped spring assembly that can be manufactured without multiple corner cuts. The present invention provides this advantage and these benefits.

OBJECTS AND SUMMARY OF THE INVENTION

It is an object of the present invention to provide an electrical female terminal that can be scaled-down in size while providing a proper resilient normal force.

It is another object of the invention to provide an electrical female terminal that can be scaled-down in size without compromising its structural integrity.

It is yet a further object of the invention to provide a scaled-down electrical female terminal that has an L-shaped spring assembly that can be manufactured without multiple, weakening corner cuts.

Still further, it is an object of the invention to provide a scaled-down electrical female terminal that can be used for tin terminals.

Accordingly, an exemplary embodiment of the present invention is directed to an electrical female terminal that includes a female terminal body and a spring assembly. The female terminal body extends along and about a longitudinal axis and has a top wall, an opposite bottom wall and a pair of opposing side walls that connected to each other to form a generally box-shaped passageway extending through the female terminal body. The spring assembly has a beam portion, an interconnect portion and a contact portion. The beam portion is connected to one of the side walls. The interconnect portion is connected generally perpendicularly to the beam portion and interconnects the beam portion and the contact portion. The contact portion is connected to the interconnect portion and projects forwardly from the interconnect portion in a cantilevered manner.

The electrical female terminal is adapted to receive a male terminal pin of a male terminal. As such, the spring assembly is operative to move between a normal, relaxed state and a flexed state but is resiliently biased to the normal, relaxed state. As the male terminal is inserted through an opening into the generally box-shaped passageway, the male terminal pin contacts the contact portion and moves spring assembly from the normal, relaxed state into the flexed state by causing the contact portion to move towards the top wall. And, as the contact portion moves to the top wall, the spring assembly simultaneously twists towards the one side wall to which the beam portion is connected.

The present invention will be better appreciated in view of the detailed description of the exemplary embodiment of the present invention with reference to the accompanying drawings, in which:

BRIEF DESCRIPTION OF THE DRAWING FIGURES

DETAILED DESCRIPTION OF THE EXEMPLARY EMBODIMENT

The detailed description of the exemplary embodiment of the present invention is hereinafter described. However, a skilled artisan will appreciate that terms such as "top", "bottom", "forwardly", "rearwardly", "upper", "lower" and the like are used herein for the purpose of simplifying the explanation of the exemplary embodiment of the present invention and of ease of understanding of the exemplary embodiment of the present invention as illustrated on the sheets of drawing figures. These terms are intended to orient the exemplary embodiment of the present invention on the sheets of drawing figures only for ease of understanding the invention and are not intended to orient the exemplary embodiment of the present invention in three-dimensional space. Thus, these terms should not be construed in any manner to narrow scope of the invention. One of ordinary skill in the art would easily comprehend that non-descriptive, non-orienting terms such as "first" and "second" and the like could easily be substituted for any of these terms.

Figure 1:
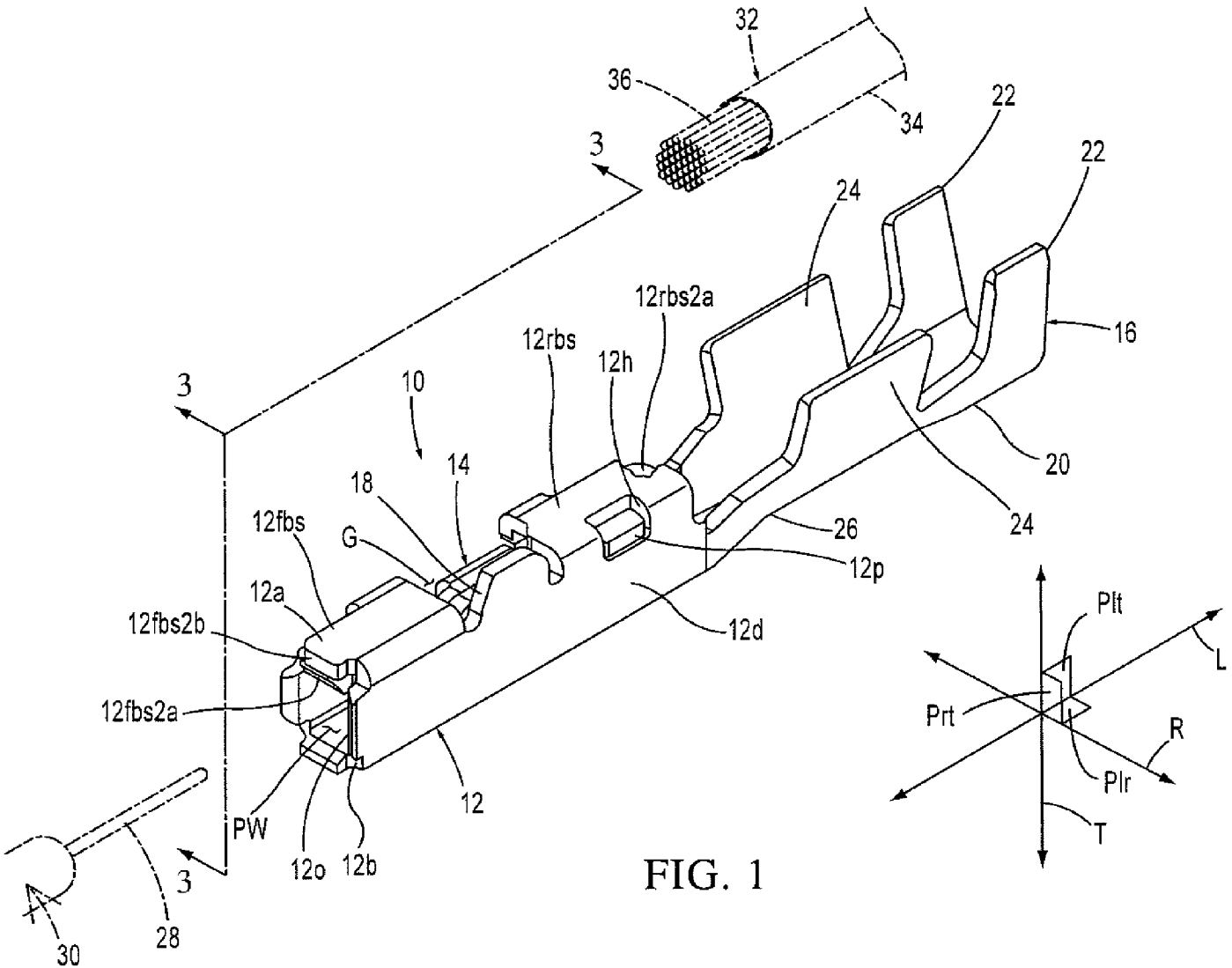
FIG. 1 is a perspective view of an exemplary embodiment of a female terminal of the present invention.
Figure 2:
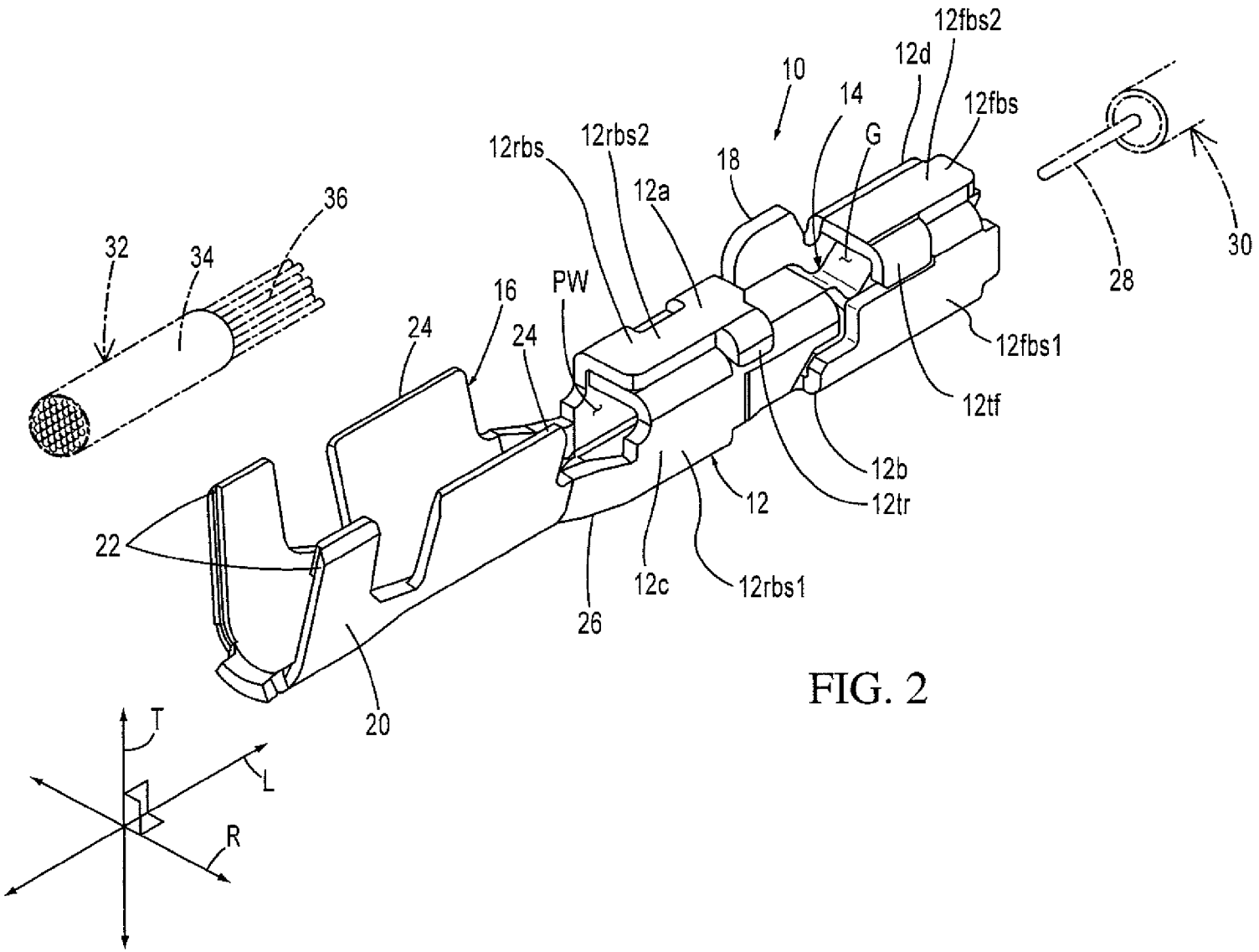
FIG. 2 is a reverse perspective view of the exemplary embodiment of the female terminal of the present invention.

As shown in FIGS. 1-12B, an exemplary embodiment of the present invention is an electrical female terminal 10 (hereinafter referred to as "female terminal 10"). The female terminal 10 has a female terminal body 12, a spring assembly 14 and a clamping member 16. As shown in FIGS. 1 and 2, the female terminal 10 extends along a longitudinal axis L and is oriented about a Cartesian coordinate system where a lateral axis R, a transverse axis T and the longitudinal axis L perpendicularly intersect one another at a point P. In turn, the longitudinal axis L and the lateral axis R define a longitudinal-lateral plane Plr, the longitudinal axis L the transverse axis T define a longitudinal-transverse plane Plt and the lateral axis R and the transverse axis T define a lateral-transverse plane Prt.

As best shown in FIGS. 1-5, the female terminal body 12 has a top wall 12*a*, an opposite bottom wall 12*b* and a pair of opposing side walls 12*c* and 12*d* that are connected to each other to form a generally box-shaped passageway PW. The generally box-shaped passageway PW extends through the female terminal body 12.

Figure 3:
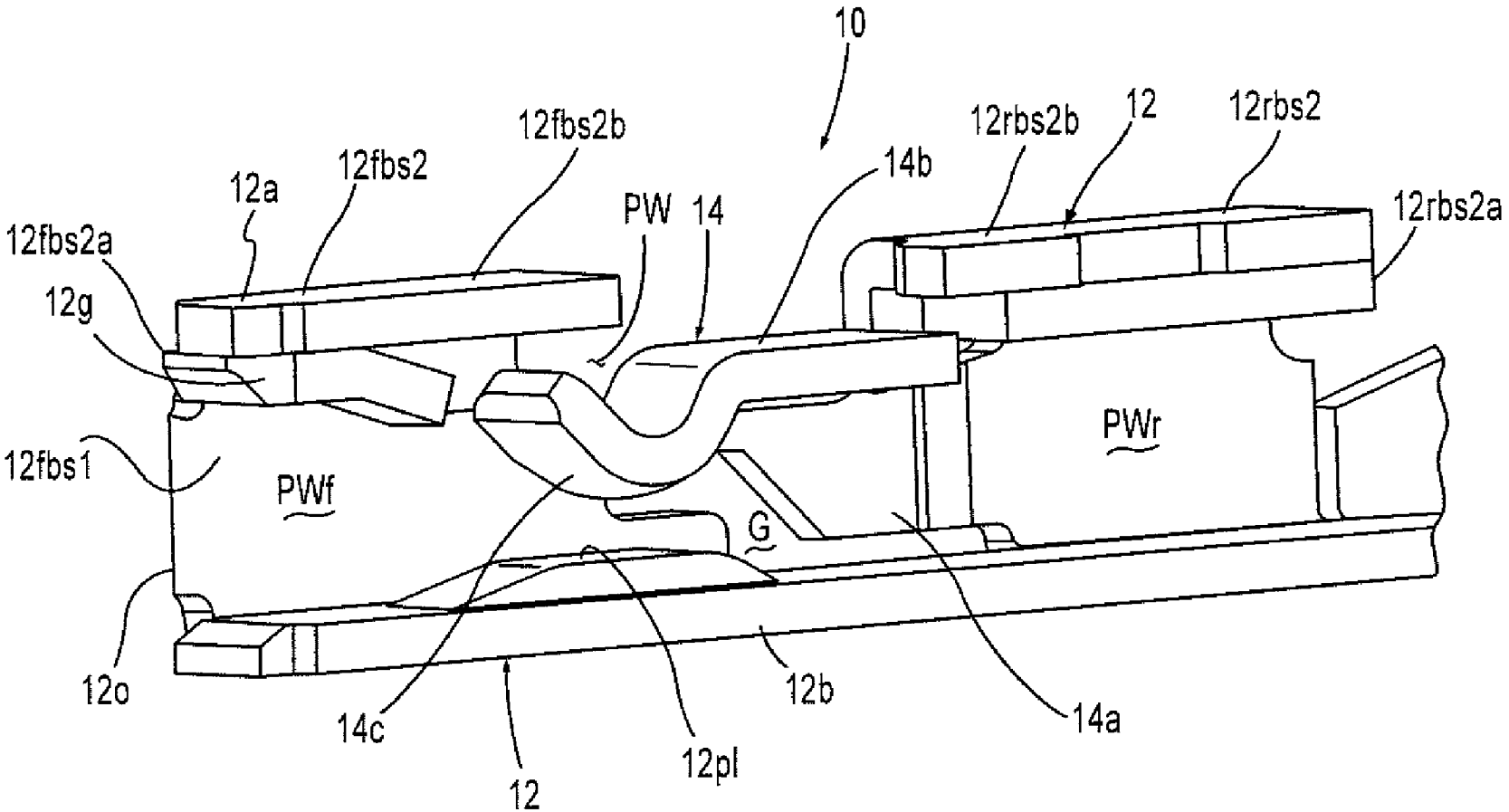
FIG. 3 is an enlarged partial perspective view shown in cross-section of the exemplary embodiment of the female terminal of the present invention taken along line 3-3-3 in FIG. 1.
Figure 4:
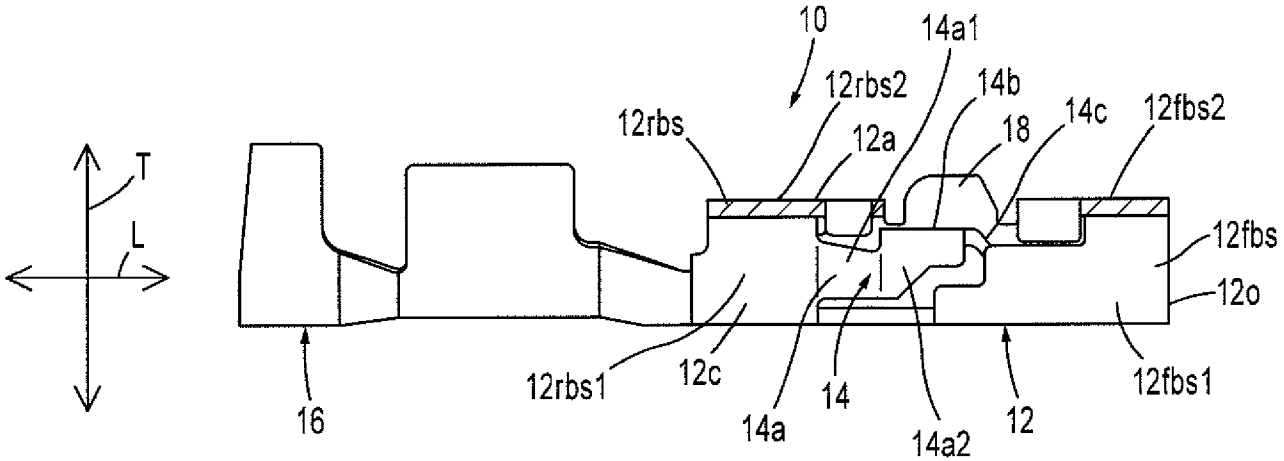
FIG. 4 is a side elevation view of the exemplary embodiment of the female terminal of the present invention in FIG. 2.
Figure 5:
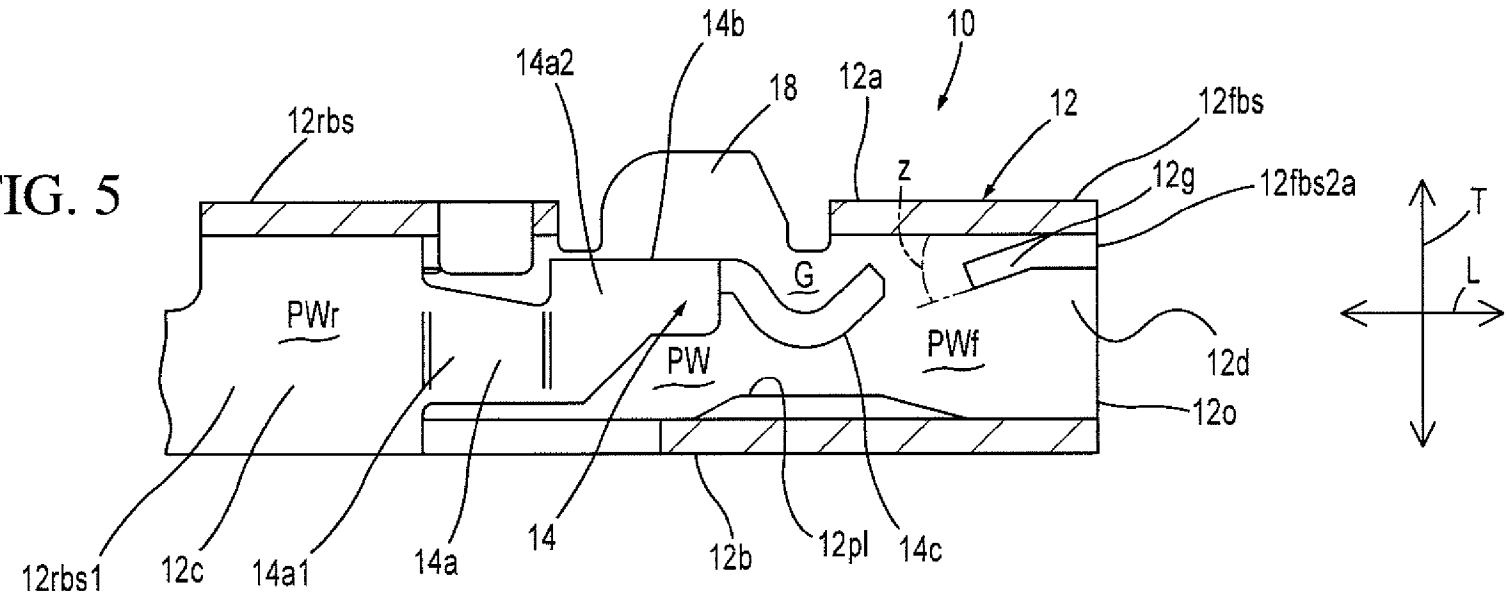
FIG. 5 is an enlarged partial side elevation view of the exemplary embodiment of the female terminal of the present invention in FIG. 4.
Figure 6:
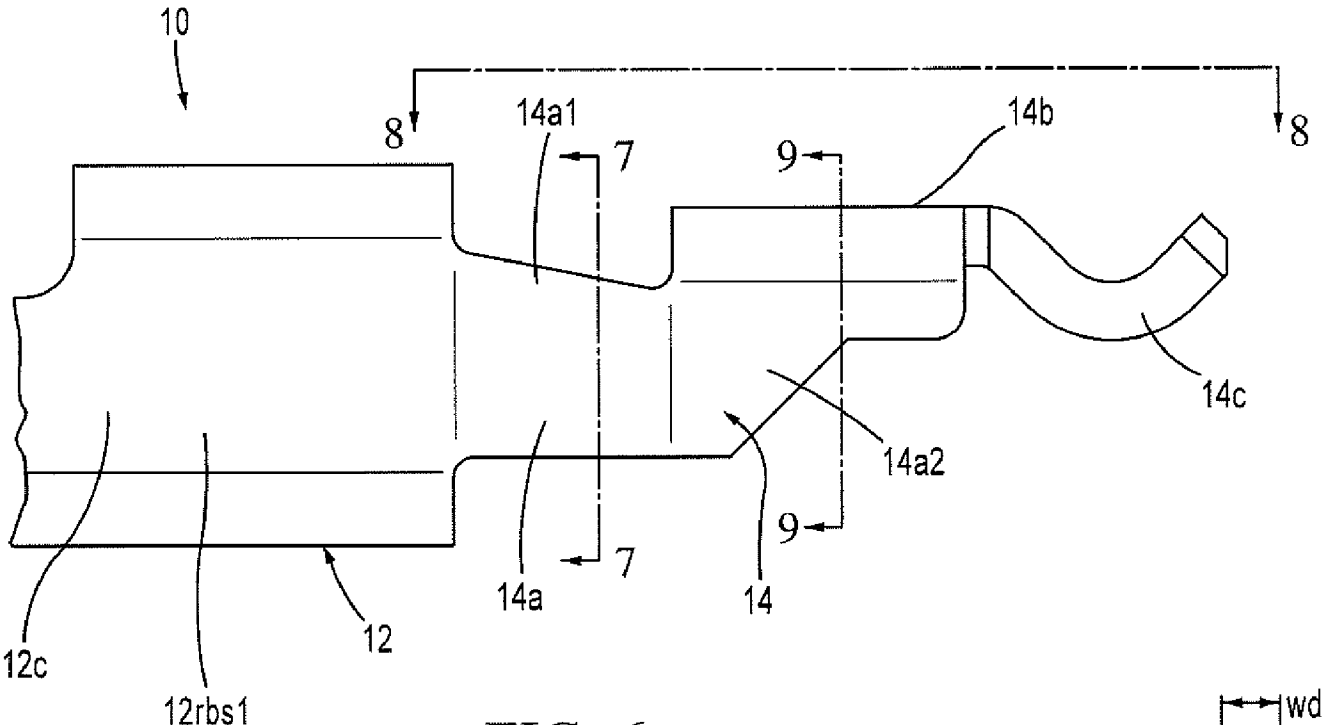
FIG. 6 is an enlarged partial side view of the exemplary embodiment of the female terminal of the present invention and broken away to emphasize a spring assembly.
Figure 9:
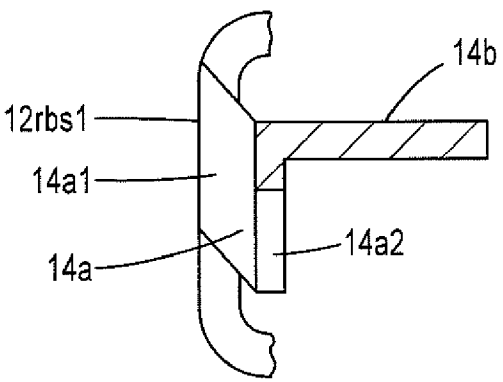
FIG. 9 is a partial front elevation view partially in cross-section of the exemplary embodiment of the female terminal taken along line 9-9 in FIG. 6.
Figure 8:
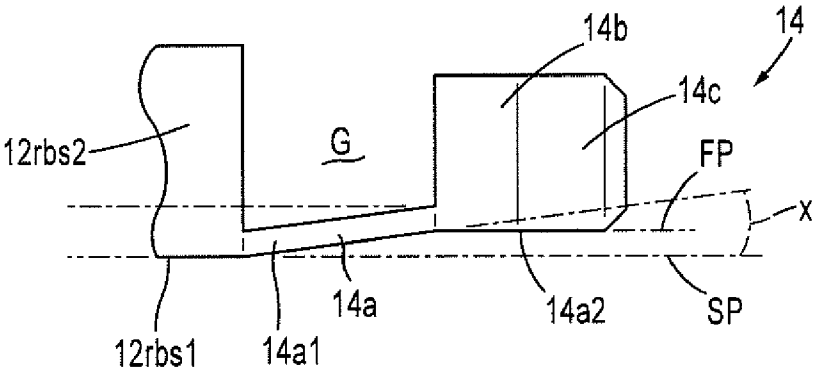
FIG. 8 is a partial top plan view of the spring assembly of the exemplary embodiment of the female terminal taken along line 8-8 in FIG. 6 generally of the spring assembly.

With reference to FIGS. 3-5, the spring assembly 14 has a beam portion 14*a*, an interconnect portion 14*b* and a contact portion 14*c*. The beam portion 14*a* is integrally connected to one of the side walls, particularly, the side wall 12*c* as best shown in FIGS. 4-6. The interconnect portion 14*b* shown best in FIGS. 6, 8 and 9 is connected generally perpendicularly to the beam portion 14*a* and interconnects the beam portion 14*a* and the contact portion 14*c*. The contact portion 14*c* is integrally connected to the interconnect portion 14*b* and projects forwardly from interconnect portion 14*b* in a cantilevered manner as illustrated in FIGS. 6 and 8.

By way of example only and not by way of limitation and as shown in FIGS. 1-3, the female terminal body 12 includes a forward box-shaped section 12*fbs* and a rearward box-shaped section 12*rbs*. The forward box-shaped section 12*fbs* forms a forward box-shaped passageway portion PWf and the rearward box-shaped section 12*rbs* forms a rearward box-shaped passageway portion PWr. Note that the forward box-shaped section 12*fbs* and the rearward box-shaped section 12*rbs* are disposed apart from one another and that at least the beam portion 14*a* and the interconnect portion 14*b* are disposed between the forward box-shaped section 12*fbs* and the rearward box-shaped section 12*rbs* as best shown in FIGS. 1, 2, 4 and 5. Further, note that at least a forward-most part 14*cf* of the contact portion 14*c* is disposed in the forward box-shaped passageway PWf of the forward box-shaped section 12*fbs* of the female terminal body 12 as best shown in FIGS. 3 and 5.

As illustrated in FIGS. 1 and 3, the forward box-shaped section 12*fbs* and the rearward box-shaped section 12*rbs* are connected to each other by the bottom wall 12*b* which is a single continuous bottom wall 12*b* (FIG. 3) and the side wall 12*d* which is a single continuous side wall 12*d* (FIG. 1). The single continuous bottom wall 12*b* and the single continuous side wall 12*d* are integrally and perpendicularly connected to each other. With reference to FIGS. 2 and 4, the forward box-shaped section 12*fbs* includes a foreshortened forward side wall piece 12*fbs*1 and a foreshortened top wall piece 12*fbs*2. The foreshortened forward side wall piece 12*fbs*1 and the foreshortened top wall piece 12*fbs*2 are integrally and perpendicularly connected to each other. Also, the rearward box-shaped section 12*rbs* includes a foreshortened rearward side wall piece 12*rbs*1 and a foreshortened rearward top wall piece 12*rbs* 2 that is integrally and perpendicularly connected to the foreshortened rearward side wall piece 12*rbs*1.

By virtue of the arrangement described immediately above, a gap G is formed as shown in FIGS. 1, 2, 3 and 5. The gap G is formed in the female terminal body 12 between the integrally-connected foreshortened forward side wall piece 12*fbs*1 and the foreshortened top wall piece 12*fbs*2 and the integrally-connected foreshortened rearward side wall piece 12*rbs*1 and the foreshortened rearward top wall piece 12*rbs*2. As illustrated in FIG. 5, one of ordinary skill in the art would appreciate that the forward box-shaped passageway portion PWf, the gap G and the rearward box-shaped passageway portion PWr constitute the entirety of the generally box-shaped passageway PW. As best shown in FIG. 5, substantially all of the spring assembly 14 is disposed in the gap G. More specifically, at least the beam portion 14*a* and the interconnect portion 14*b* of the spring assembly 14 are disposed in the gap G of the generally box-shaped passageway PW while the contact portion 14 is partially disposed in the gap G and partially disposed in the forward box-shaped passageway portion PWf.

Figure 7:
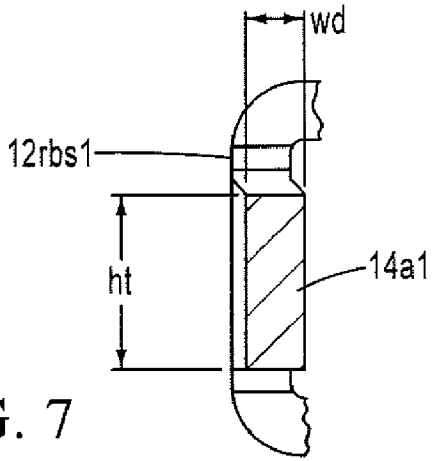
FIG. 7 is a partial front elevation view partially in cross-section of the exemplary embodiment of the female terminal taken along line 7-7 in FIG. 6.

In FIGS. 4, 5 and 6, the beam portion 14*a* includes a flat-panel beam anchor piece 14*a*1 and a flat-panel beam connector piece 14*a*2. The flat-panel beam connector piece 14*a*2 is integrally connected to the flat-panel beam anchor piece 14*a*1 and the flat-panel beam anchor piece 14*a*1 is integrally connected to the foreshortened rearward side wall piece 12*rbs*1. As shown in FIGS. 7-9, the flat-panel beam anchor piece 14*a*1 extends from the foreshortened rearward side wall piece 12*rbs*1 into the gap G (FIG. 8) at an angle x. In this configuration, the spring assembly 14 is disposed in the gap G of the generally box-shaped passageway PW.

In FIGS. 6, 8 and 9, the interconnect portion 14*b* has a flat-panel configuration and the contact portion 14*c* has a U-shape configuration (FIG. 6). The interconnect portion 14*b* and the contact portion 14*c* are integrally connected to each other. As best shown in FIG. 9, the flat-panel beam connector piece 14*a*2 and the interconnect portion 14*b* are integrally connected to each other to form an L-shape cross-sectional configuration. (In FIG. 9, note that the L-shape is rotated clockwise 90°). As best shown in FIG. 8, the flat-panel beam connector piece 14*a*2 defines a first plane FP (illustrated as a dashed line) and the foreshortened rearward side wall piece 12*rbs*1 defines a second plane SP (also illustrated as a dashed line). Note that the first plane FP and second plane SP extend parallel to each other.

With reference to FIGS. 1, 2 and 5, the forward box-shaped section 12*fbs* and the rearward box-shaped section 12*rbs* are connected to each other by the bottom wall 12*b* which is a single continuous bottom wall 12*b* and the side wall 12*d* which is a single continuous side wall 12*d*. The single continuous bottom wall 12*b* and the single continuous side wall 12*d* are integrally and perpendicularly connected to each other.

As best shown in FIGS. 1 and 3, the foreshortened forward top wall piece 12*fbs*2 includes a lower forward top wall piece portion 12*fbs*2*a* that is integrally connected to the foreshortened forward side wall piece 12*fbs*1 and an upper forward top wall piece portion 12*fbs*2*b* that is integrally connected to the single continuous side wall 12*d* and is folded over onto the lower forward top wall piece portion 12*fbs*2*a*. As best shown in FIGS. 2 and 3, the foreshortened rearward top wall piece 12*rbs*2 includes a lower rearward top wall piece portion 12*rbs*2*a* that integrally connected to the foreshortened rearward side wall piece 12*rbs*1 and an upper rearward top wall piece portion 12*rbs*2*b* that is integrally connected to the single continuous side wall 12*d* and is folded over onto the lower rearward top wall piece portion 12*rbs*2*a*.

With reference to FIG. 1, the single continuous side wall 12*d* has an engagement hole 12*h* formed therethrough and the lower rearward top wall piece portion 12*rbs*2*a* has an engagement projection 12*p*. The engagement projection is sized and adapted to be received by the engagement hole 12*h* in a close-fitting relationship as shown in FIG. 1. As illustrated in FIG. 2, the foreshortened forward top wall piece 12*fbs*2 has a forward top wall piece tab 12*tf* that is disposed generally centrally of the forward box-shaped section 12*fbs* and extends downwardly towards the foreshortened forward side wall piece 12*fbs*1. Also, in FIG. 2, the foreshortened rearward top wall piece 12*rbs*2 has a rearward top wall piece tab 12*tr* that is disposed forwardly thereof and extends downwardly towards the spring assembly 14.

By way of example only and not by way of limitation the female terminal 10 also includes an orientation projection 18 as best shown in FIGS. 2, 4 and 5. The orientation projection 18 is integrally connected to the single continuous side wall 12*b* and projects above the top wall 12*a*. The orientation projection 18 is fabricated from a flat-panel material.

In FIGS. 1 and 2, the clamping member 16 includes a channel member 20. The channel member 20 has a pair of wire-insulation clamping tabs 22 and 22 and a pair of wire-clamping tabs 24 and 24. Both the pair of wire-insulation clamping tabs 22 and 22 and the pair of wire-clamping tabs 24 and 24 project from the channel member 20. The clamping member 16 also includes a neck member 26 that is integrally connected to the channel member 20. Respective ones of the pair of wire-clamping tabs 24 and 24 are positioned between respective ones of the wire-insulation clamping tabs 22 and 22 and the neck member 26. The neck member 26 is integrally connected rearwardly of the female terminal body 12 thereby integrally interconnecting the channel member 20 and the female terminal body 12.

In FIGS. 1 and 2, a wire 32 has an insulation sleeve 34 and a wire core 36. As is known in the art, the pair of wire-clamping tabs 24 and 24 are adapted to clamp the wire core 36 and the pair of wire-insulation clamping tabs 22 and 22 are adapted to clamp the insulation sleeve 34.

Furthermore, as best shown in FIGS. 3 and 5, the electrical female terminal 10 also includes a guide member 12*g*. The guide member 12*g* is disposed forwardly and internally of the female terminal body 12 adjacent an opening 12*o* into the generally box-shaped passageway PW as shown in FIG. 1. The guide member 12*g* is connected to the top wall 12*a* and extends at an angle z (FIG. 5) inwardly into the generally box-shaped passageway PW and away from the top wall 12*a*. Additionally, the electrical female terminal 10 includes a plateau 12*pl*. The plateau 12*pl* is connected to the bottom wall 12*b* and is facially opposed to the contact portion 14*c* of the spring assembly 14.

Figure 10:
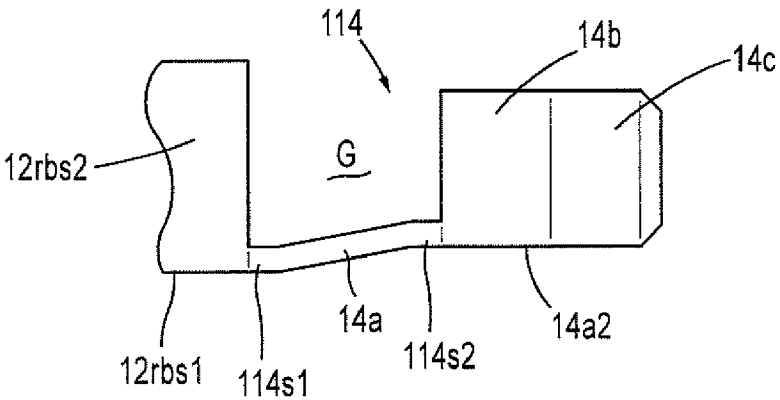
FIG. 10 is a partial top plan view partially of an alternative spring assembly of the one shown in FIG. 8.

An alternative arrangement of a spring assembly 114 is illustrated in FIG. 10. The spring assembly 114 is substantially similar to the spring assembly 14 described above. The only exceptions are that the spring assembly 114 has a first straight segment 114*s*1 and a second straight segment 114*s*2 that are connected onto the beam portion 14*a* as end parts.

Figure 11B:
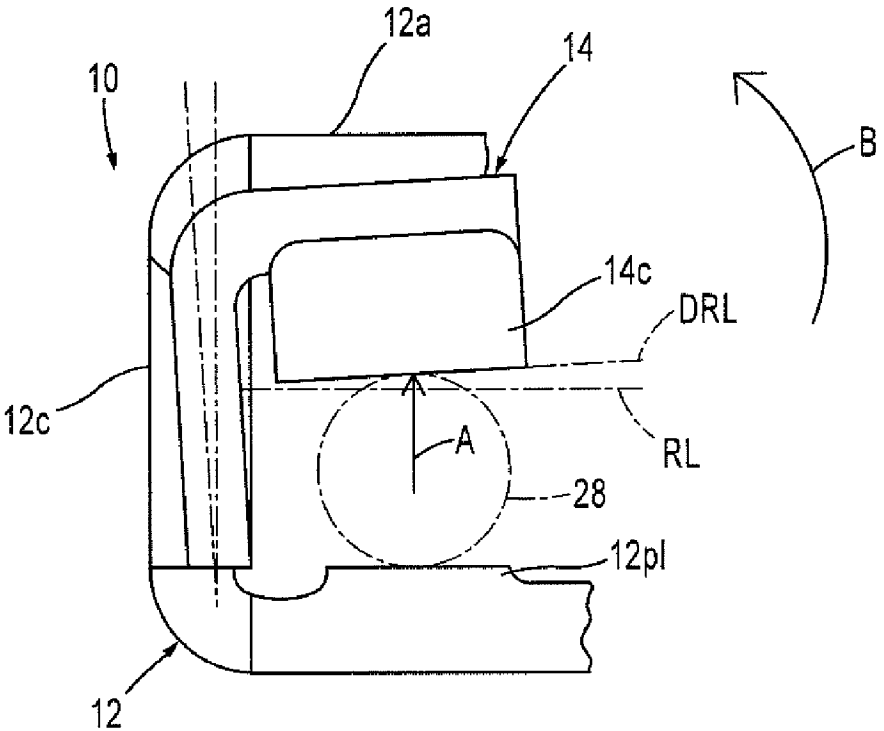
FIG. 11B is a partial front elevation view partially in cross-section of the exemplary embodiment of the female terminal of the present invention illustrating the spring assembly in a flexed state.
Figure 11A:
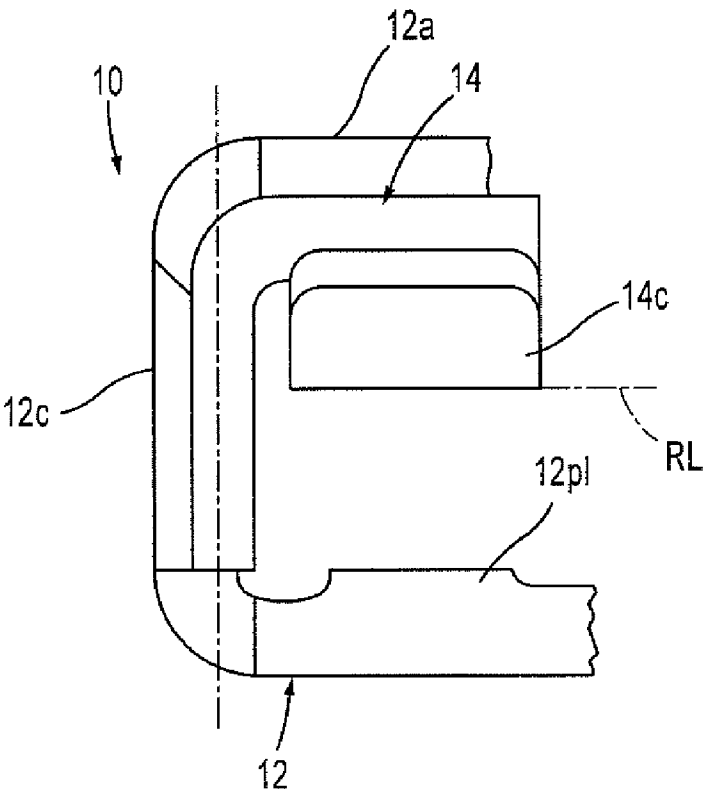
FIG. 11A is a partial front elevation view partially in cross-section of the exemplary embodiment of the female terminal of the present invention illustrating the spring assembly in a normal, relaxed state.
Figure 12A:
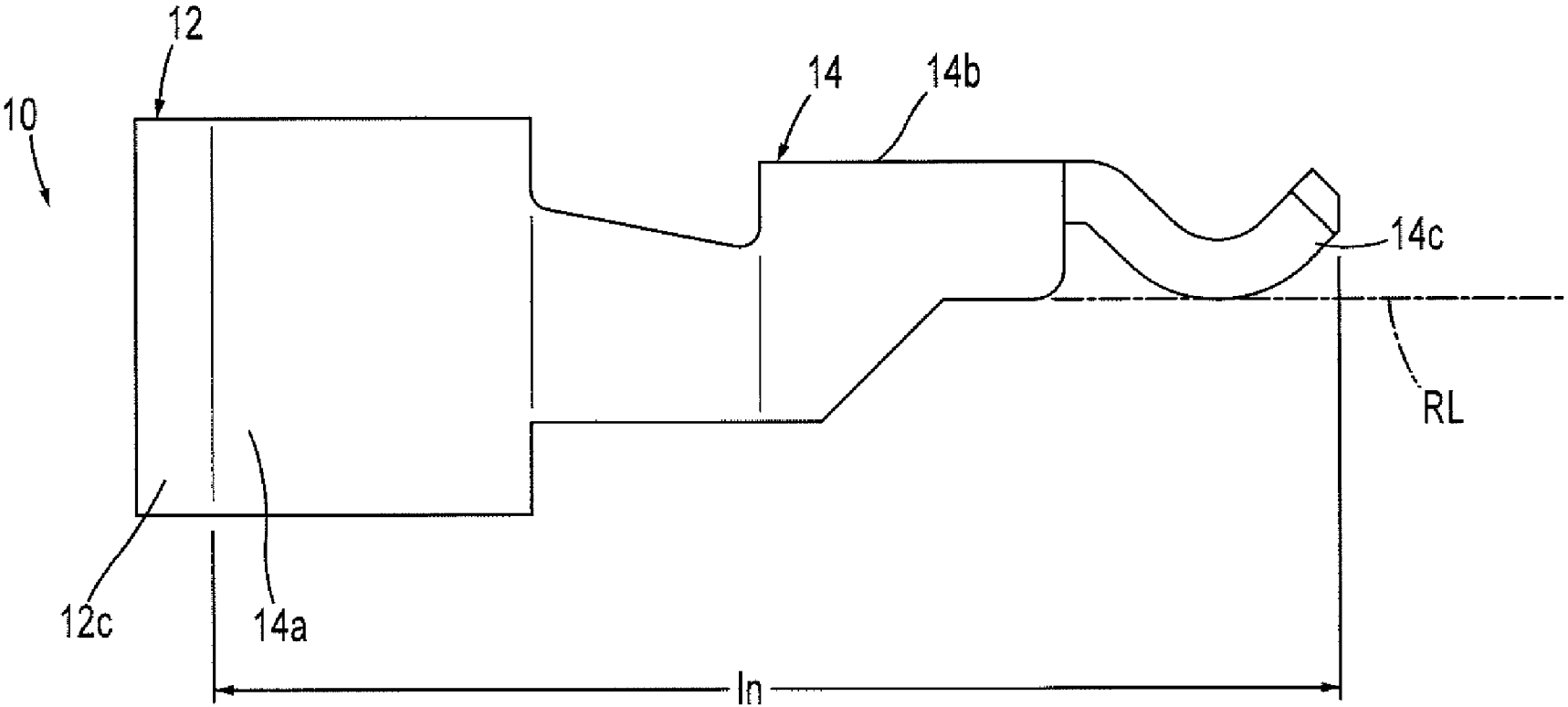
FIG. 12A is a partial side elevation view of the exemplary embodiment of the female terminal of the present invention illustrating the spring assembly in the normal, relaxed state.
Figure 12B:
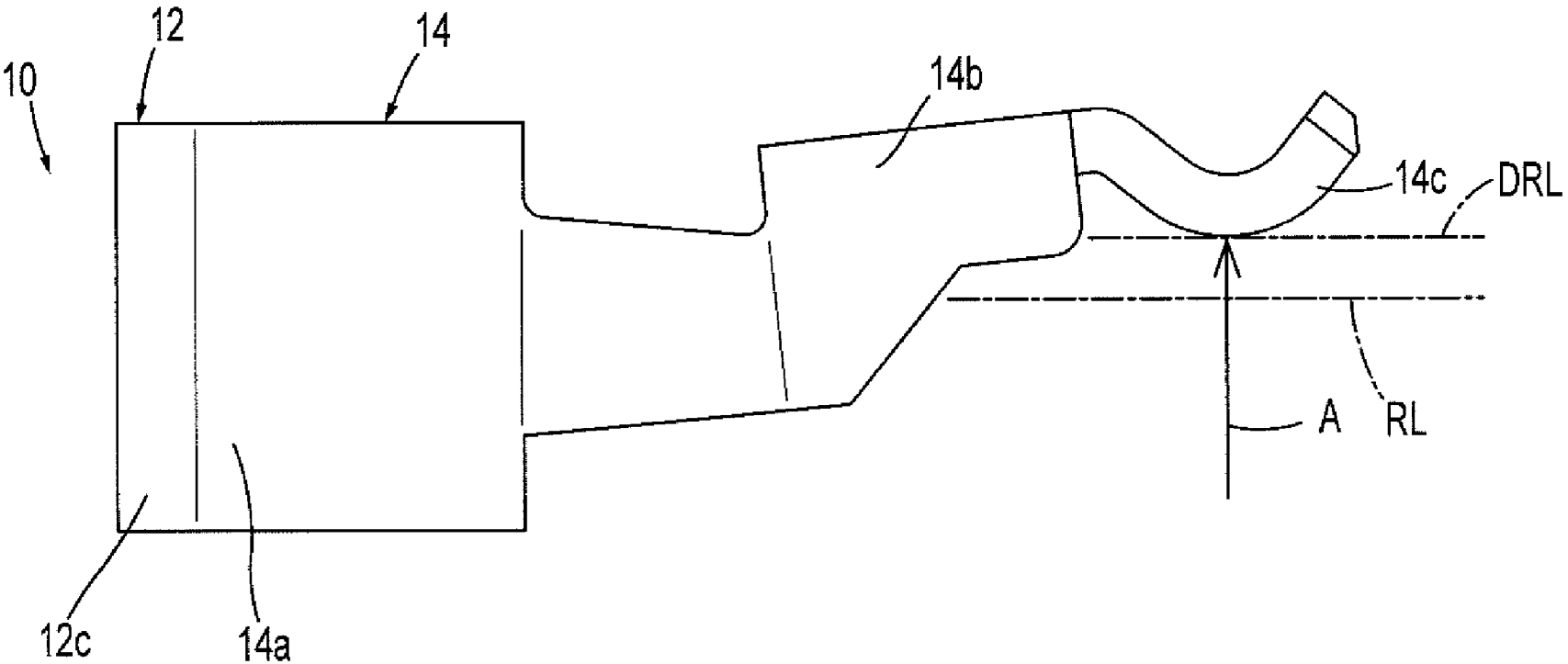
FIG. 12B is a partial side elevation view of the exemplary embodiment of the female terminal of the present invention illustrating the spring assembly in the flexed state.

With reference to FIGS. 1, 2 and 11A-12B, the electrical female terminal 10 is operative to receive a male terminal pin 28 of a male terminal 30. FIGS. 11A-12B illustrate how the spring assembly 14 operates in conjunction with the male terminal 30. The spring assembly 14 is operative to move between a normal, relaxed state (FIGS. 11A and 12A) and a flexed state (FIGS. 11B and 12B). The spring assembly 14 is resiliently biased to the normal, relaxed state (FIGS. 11A and 12A). As the male terminal pin 28 is inserted into the passageway PW through the opening 12*o* (FIG. 1), the male terminal pin 28 contacts the contact portion 14 (FIG. 11B) and moves spring assembly 14 from the normal, relaxed state (FIGS. 11A and 12A) into the flexed state (FIGS. 11B and 12B) by causing the contact portion 14*c* to move towards the top wall 12*a* as illustrated by the upwardly pointing arrow A from a reference line RF to a displacement reference line DRF. In short, the spring assembly 14 is in the normal, relaxed state at the reference line RF and is in the flexed state at displacement reference line DRF. Also, as the contact portion 14*c* moves to the top wall 12*a*, the spring assembly 14 simultaneously twists (FIG. 11B) towards the side wall 12*c* as reflected by curved arrow B. As discussed above, side wall 12*c* is the side wall to which the beam portion is connected.

One of ordinary skill in the art would appreciate that FIGS. 11A-12B are enlarged drawing figures that intentionally exaggerate the displacement of the spring assembly 14 relative to the female terminal body 10 for ease of understanding the operability of the invention. Also, although not by way of limitation, the twisted spring assembly 14, i.e., the spring assembly 14 in its flexed state, as best shown in FIG. 11B, remains within the confines of the female terminal body 12.

A skilled artisan would understand that the male terminal pin 28 applies a male terminal pin force to the contact portion 14*c* and, simultaneously therewith, the contact portion 14*c* of the spring assembly 14 applies and equal and opposite force to the male terminal pin which is hereinafter referred to as a proper resilient normal force. An advantage of the electrical female terminal 10 of the present invention is that the proper resilient normal force can be adjusted, if desired. By way of example only and not by way of limitation, as shown in FIG. 7, a height ht of the flat-panel beam anchor piece 14*a*1 can be increased or decreased. Alternatively or in conjunction with changing the height ht of the flat-panel beam anchor piece 14*a*1, a width wd of the flat-panel beam anchor piece 14*a*1 can be increased or decreased. Changing the height ht or the width wd or both the height ht and the width wd changes the size of the beam portion 14*a* and thus the resiliency of the flat-panel beam anchor piece 14*a*1. As a result, by changing the resiliency of the beam portion 14*a*, the proper resilient normal force also changes. Alternatively or in conjunction with changing the height ht or the width wd of the flat-panel beam anchor piece 14*a*1, a length ln of the anchor assembly 14 as shown in FIG. 12A can be either lengthened or shortened thereby changing the proper resilient normal force.

The electrical female terminal 10 of the present invention can be scaled-down in size while simultaneously providing a proper resilient normal force. Additionally, the electrical female terminal 10 of the present invention can be scaled-down in size without compromising structural integrity. Also, the electrical female terminal 10 of the present invention is a scaled-down electrical female terminal that has an L-shaped spring assembly that can be manufactured without multiple, weakening corner cuts. Further, the electrical female terminal 10 of the present invention is a scaled-down electrical female terminal that can be used for tin terminals. Furthermore, the proper resilient normal force of the spring assembly being applied to the male terminal pin can be adjusted by changing any one, any combination or all of the height, width and length of the spring assembly.

The present invention, may, however, be embodied in various different forms and should not be construed as limited to the exemplary embodiment set forth herein; rather, this exemplary embodiment is provided so that this disclosure will be thorough and complete and will fully convey the scope of the present invention to those skilled in the art. Further, one of ordinary skill in the art would appreciate that the claims may or may not include any or all of the objects of the invention set forth hereinabove.

What is claimed is:

1. An electrical female terminal, comprising:

a female terminal body extending along and about a longitudinal axis and having a top wall, an opposite bottom wall and a pair of opposing side walls connected to each other to form a generally box-shaped passageway extending therethrough; and a spring assembly having a beam portion, an interconnect portion and a contact portion, the beam portion having a first beam portion section and a second beam portion section, the first beam portion section connected to one of the side walls and extending at an angle therefrom into the passageway, the second beam section portion connected to the first beam section portion and extending generally parallel to the one of the side walls, the interconnect portion connected generally perpendicularly to the second beam portion section and interconnecting the second beam portion section and the contact portion and the contact portion connected to the interconnect portion and projecting forwardly therefrom in a cantilevered manner.

2. An electrical female terminal according to claim 1, wherein the female terminal body includes a forward box-shaped section forming a forward box-shaped passageway portion and a rearward box-shaped section forming a rearward box-shaped passageway portion and disposed apart from the forward box-shaped section, at least the beam portion and the interconnect portion being disposed between the forward box-shaped section and the rearward box-shaped section.

3. An electrical female terminal according to claim 2, wherein at least a forward-most part of the contact portion is disposed in the forward box-shaped passageway portion of the forward box-shaped section of the female terminal body.

4. An electrical female terminal according to claim 2, wherein the forward box-shaped section and the rearward box-shaped section are connected to each other by a single continuous bottom wall and a single continuous side wall, the single continuous bottom wall and the single continuous side wall being integrally connected to each other.

5. An electrical female terminal according to claim 4, further comprising an orientation projection integrally connected to the single continuous side wall and projecting above the top wall.

6. An electrical female terminal according to claim 2, wherein the forward box-shaped section includes a foreshortened forward side wall piece and a foreshortened top wall piece integrally connected to the foreshortened forward side wall piece and the rearward box-shaped section includes a foreshortened rearward side wall piece and a foreshortened rearward top wall piece integrally connected to the foreshortened rearward side wall piece.

7. An electrical female terminal according to claim 6, wherein the forward box-shaped section and the rearward box-shaped section are connected to each other by a single continuous bottom wall and a single continuous side wall, the single continuous bottom wall and the single continuous side wall being integrally connected to each other.

8. An electrical female terminal according to claim 1, further comprising a clamping member including a channel member with a pair of wire-insulation clamping tabs and a pair of wire-clamping tabs projecting from the channel member and a neck member integrally connected to the channel member, respective ones of the pair of wire-clamping tabs being positioned between respective ones of the wire-insulation clamping tabs and the neck member, the neck member being integrally connected rearwardly of the female terminal body.

9. An electrical female terminal according to claim 1, further comprising a guide member disposed forwardly and internally of the female terminal body adjacent an opening into the generally box-shaped passageway, the guide member being connected to the top wall and extending at an angle inwardly into the generally box-shaped passageway and away from the top wall.

10. An electrical female terminal according to claim 1, further comprising a plateau connected to the bottom wall and facially opposed to the contact portion of the spring assembly.

11. An electrical female terminal comprising:

a female terminal body extending along and about a longitudinal axis and having a top wall, an opposite bottom wall and a pair of opposing side walls connected to each other to form a generally box-shaped passageway extending therethrough; and a spring assembly having a beam portion, an interconnect portion and a contact portion, the beam portion connected to one of the side walls, the interconnect portion connected generally perpendicularly to the beam portion and interconnecting the beam portion and the contact portion and the contact portion connected to the interconnect portion and projecting forwardly therefrom in a cantilevered manner, wherein the female terminal body includes a forward box-shaped section forming a forward box-shaped passageway portion and a rearward box-shaped section forming a rearward box-shaped passageway portion and disposed apart from the forward box-shaped section, at least the beam portion and the interconnect portion being disposed between the forward box-shaped section and the rearward box-shaped section, wherein the forward box-shaped section includes a foreshortened forward side wall piece and a foreshortened top wall piece integrally connected to the foreshortened forward side wall piece and the rearward box-shaped section includes a foreshortened rearward side wall piece and a foreshortened rearward top wall piece integrally connected to the foreshortened rearward side wall piece and wherein a gap is formed in the female terminal body between the integrally-connected foreshortened forward side wall piece and the foreshortened top wall piece and the integrally-connected foreshortened rearward side wall piece and the foreshortened rearward top wall piece and wherein at least the beam portion and the interconnect portion of the spring assembly are disposed in the gap.

12. An electrical female terminal according to claim 11, wherein the beam portion includes a flat-panel beam anchor piece and a flat-panel beam connector piece integrally connected to the flat-panel beam anchor piece, the flat-panel beam anchor piece integrally connected to the foreshortened rearward side wall piece and extending from the foreshortened rearward side wall piece into the gap.

13. An electrical female terminal according to claim 12, wherein the interconnect portion has a flat-panel configuration and the contact portion has a U-shape configuration, the interconnect portion and the contact portion being integrally connected to each other, the flat-panel beam connector piece and the interconnect portion being integrally connected to each other to form an L-shape cross-sectional configuration.

14. An electrical female terminal according to claim 13, wherein the flat-panel beam connector piece defines a first plane and the foreshortened rearward side wall piece defines a second plane, the first and second planes being parallel to each other.

15. An electrical female terminal comprising:

a female terminal body extending along and about a longitudinal axis and having a top wall, an opposite bottom wall and a pair of opposing side walls connected to each other to form a generally box-shaped passageway extending therethrough; and a spring assembly having a beam portion, an interconnect portion and a contact portion, the beam portion connected to one of the side walls, the interconnect portion connected generally perpendicularly to the beam portion and interconnecting the beam portion and the contact portion and the contact portion connected to the interconnect portion and projecting forwardly therefrom in a cantilevered manner, wherein the female terminal body includes a forward box-shaped section forming a forward box-shaped passageway portion and a rearward box-shaped section forming a rearward box-shaped passageway portion and disposed apart from the forward box-shaped section, at least the beam portion and the interconnect portion being disposed between the forward box-shaped section and the rearward box-shaped section, wherein the forward box-shaped section includes a foreshortened forward side wall piece and a foreshortened top wall piece integrally connected to the foreshortened forward side wall piece and the rearward box-shaped section includes a foreshortened rearward side wall piece and a foreshortened rearward top wall piece integrally connected to the foreshortened rearward side wall piece, wherein the forward box-shaped section and the rearward box-shaped section are connected to each other by a single continuous bottom wall and a single continuous side wall, the single continuous bottom wall and the single continuous side wall being integrally connected to each other and wherein the foreshortened forward top wall piece includes a lower forward top wall piece portion integrally connected to the foreshortened forward side wall piece and an upper forward top wall piece portion integrally connected to the single continuous side wall and folded over onto the lower forward top wall piece portion.

16. An electrical female terminal according to claim 15, wherein the foreshortened rearward top wall piece includes a lower rearward top wall piece portion integrally connected to the foreshortened rearward side wall piece and an upper rearward top wall piece portion integrally connected to the single continuous side wall and folded over onto the lower rearward top wall piece portion.

17. An electrical female terminal according to claim 16, wherein the single continuous side wall has an engagement hole formed therethrough and the lower rearward top wall piece portion has an engagement projection sized and adapted to be received by the engagement hole in a close-fitting relationship.

18. An electrical female terminal according to claim 15, wherein the foreshortened forward top wall piece has a forward top wall piece tab disposed generally centrally of the forward box-shaped section and extending downwardly towards the foreshortened forward side wall piece.

19. An electrical female terminal according to claim 15, wherein the foreshortened rearward top wall piece has a rearward top wall piece tab disposed forwardly thereof and extending downwardly towards the spring assembly.

20. An electrical female terminal adapted to receive a male terminal pin of a male terminal, the electrical female terminal comprising:

a female terminal body extending along and about a longitudinal axis and having a top wall, an opposite bottom wall and a pair of opposing side walls connected to each other to form an opening into a generally box-shaped passageway extending through the female terminal body; and a spring assembly having a beam portion, an interconnect portion and a contact portion, the beam portion connected to one of the side walls, the interconnect portion connected generally perpendicularly to the beam portion and interconnecting the beam portion and the contact portion and the contact portion connected to the interconnect portion and projecting forwardly therefrom in a cantilevered manner, the spring assembly operative to move between a normal, relaxed state and a flexed state and being resiliently biased to the normal, relaxed state, wherein, as the male terminal is inserted into the passageway through the opening, the male terminal pin contacts the contact portion and moves spring assembly from the normal, relaxed state into the flexed state by causing the contact portion to move towards the top wall and, as the contact portion moves to the top wall, the spring assembly simultaneously twists towards the one side wall to which the beam portion is connected.

* * * * *